US006832551B2

(12) United States Patent
Jendroska et al.

(10) Patent No.: US 6,832,551 B2
(45) Date of Patent: Dec. 21, 2004

(54) END SEALING OF THE DOCTOR BLADE CHAMBER

(75) Inventors: Rainer Jendroska, Ladbergen (DE); Guido Averdiek, Georgsmarienhuette (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/270,356

(22) Filed: Oct. 15, 2002

(65) Prior Publication Data

US 2003/0121435 A1 Jul. 3, 2003

(30) Foreign Application Priority Data

Oct. 16, 2001 (DE) ..... 101 50 488

(51) Int. Cl.[7] ..... B41F 31/07
(52) U.S. Cl. ..... 101/350.6
(58) Field of Search ..... 101/350.6, 169, 101/157, 366, 363; 118/413

(56) References Cited

U.S. PATENT DOCUMENTS 2,931,297 A * 4/1960 Courdiet ..... 101/157
4,581,995 A * 4/1986 Stone ..... 101/366
5,012,736 A * 5/1991 Van Kanegan et al. ..... 101/211
5,927,199 A * 7/1999 Achelpohl et al. ..... 101/363

FOREIGN PATENT DOCUMENTS

| | | |
|---|---|---|
| EP | 0 822 897 | 2/1998 |
| WO | 96/34751 | 11/1996 |

* cited by examiner

*Primary Examiner*—Andrew H. Hirshfeld
*Assistant Examiner*—Leo T. Hinze
(74) *Attorney, Agent, or Firm*—Jacobson Holman PLLC

(57) ABSTRACT

An ink chamber for rotation printing machines having an ink roll that rotates around an axis during operation, an elongated doctor blade chamber body that limits the ink chamber at least on the side opposite the ink roll, two wedge-like doctor blades that can be set to the ink roll, two sealing bodies that limit the ends of the ink chamber, whereby the sealing surfaces of the sealing bodies are set against the ink roll, and two first intermediate walls, of which one each is arranged between the dye zone of the ink roll and the respective sealing body so that first chambers are created on each side of the doctor blade chamber between the sealing bodies and the intermediate walls. At least one of the doctor blades has a length that ends between one of the intermediate walls and the sealing body on at least one end of the ink chamber.

15 Claims, 4 Drawing Sheets

END SEALING OF THE DOCTOR BLADE CHAMBER

BACKGROUND OF THE INVENTION

1. Field of the Invention

The invention relates to a doctor blade chamber for rotation printing machines having an anilox roll that rotates around an axis during operation, an elongated doctor blade chamber body that limits the ink chamber at least on the side opposite the anilox roll, and at least one supply line through which ink reaches an interior of the ink chamber. Two wedge-like doctor blades can be set to the anilox roll, and two sealing bodies limit the ends of the ink chamber, whereby the sealing surfaces of the sealing bodies are set against the anilox roll. Two first intermediate walls, of which one each is arranged between the dye zone and the respective sealing body, create first chambers on each side of the ink chamber between the sealing bodies and the intermediate walls and at least two ink discharge bores discharge ink from the first chambers.

The task is solved by a doctor blade chamber such as that already described which further includes at least one additional intermediate wall provided between the dye zone of the anilox roll and the first intermediate walls so that at least one additional chamber is created between the first and the additional intermediate walls.

In the mentioned use of several intermediate walls, their penetration probabilities multiply so that less ink enters the first chamber than the second, which is located in closer proximity to the filled ink reservoir.

The use of the at least one intermediate wall in combination with shortened doctor blades has proven to be advantageous. This circumstance is due to the fact that in the operation of doctor blade chambers of the prior art, ink or ink residue creep along the doctor blades, and directly reach the end seal of the doctor blade chamber in this way. The use of doctor blades that end between an intermediate wall and the seal provides a remedy for this problem. The ink, or the ink residue dependent upon whether the blade is the working blade or the locking blade, respectively, then drips off the end of the doctor blades, and is accumulated in the chambers, and is discharged by means of bores, or lines. However, shortened length may be used only if the doctor blade chamber is not tilted toward the shortened doctor blade, because otherwise ink will run off between the end of the shortened doctor blade and the seal.

In this regard it is particularly advantageous that the locking doctor blade is embodied in the described manner. This circumstance is achieved in that the locking doctor blade scrapes off excess, partially dried on ink from the anilox roll. This ink residue is deposited on the exterior of the doctor blade. Especially this ink residue can substantially influence the function of the doctor blade end seals if it gets into the space between the seal and the roll. This possibility does not exist with the use of shortened locking doctor blades, as the ink residue reaches the first or second chamber, and is discharged from there through the bores, or lines, respectively, that are assigned to the respective chambers.

Doctor blade chambers according to the invention are suitable both in the use of an open (atmosphere pressure) and in the use of a closed (ink is under pressure, will possibly be pumped) ink feeding system.

Additional advantageous embodiments and embodiment examples of the invention are found in the additional claims, the subject description, and the drawings.

The individual figures show:

DETAILED DESCRIPTION OF THE PREFERRED EMBODIMENTS

Figure 1A:
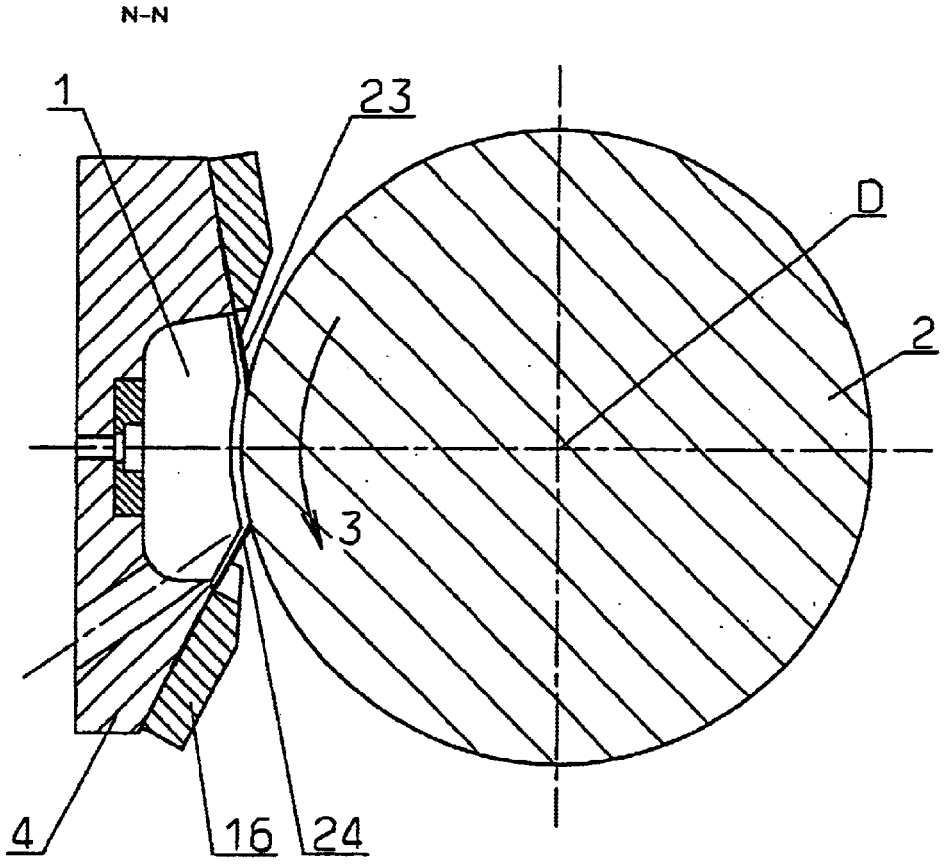
FIG. 1*a* A section through a doctor blade chamber along the line N—N
Figure 1B:
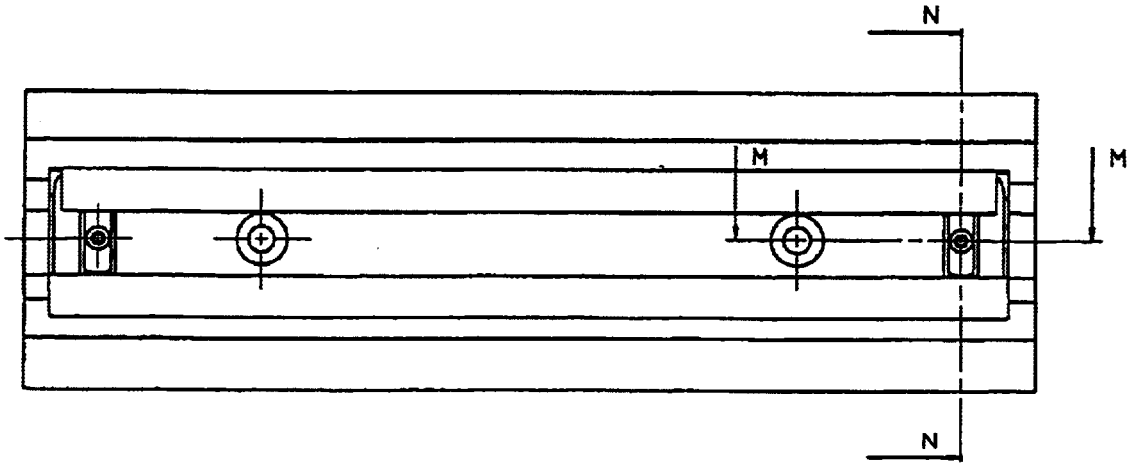
FIG. 1*b* A top view of the doctor blade chamber, whereby the anilox roll is disavowed from the doctor blade chamber body FIG. 2 An isometric view of the doctor blade chamber with a disavowed anilox roll, whereby only the elements in the proximity of the end of the doctor blade chamber are shown, and whereby the doctor blades and their support rails are not illustrated FIG. 3 A top view of the elements of the doctor blade chamber shown in FIG. 2, whereby the doctor blades and their support rails are also not illustrated FIG. 4 Another isometric view of an end of the doctor blade chamber from a slightly different viewing angle, whereby the doctor blades and their support rails are also not illustrated FIG. 5 A top view of the doctor blade chamber with support rails and doctor blades, whereby only the elements in the proximity of the end of the doctor blade chamber are shown FIG. 6 An isometric view of the characteristics shown in FIG. 5

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. FIG. 1*a* shows a section through an embodiment example of the invention. This figure clearly shows that the anilox roll 2, which during its operation rotates around the axis D in the direction of the curved arrow 3, the ink chamber body 4, as well as the locking 23 and working doctor blade 24, limit the ink chamber 1. Further it is shown in which way both doctor blades are retained by the support rails 16. FIG. 1*b* shows a top view of the doctor blade chamber 1 with a disavowed anilox roll 2. In addition to the elements shown in the other figures, the positions of the sections N—N and M—M, as well as the bores 26 for the fastening screws of the doctor blade chamber are illustrated.

Figure 2:
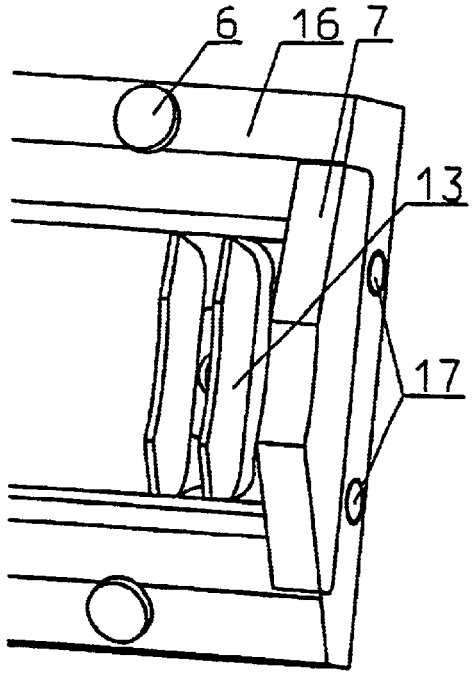
Figure 3:
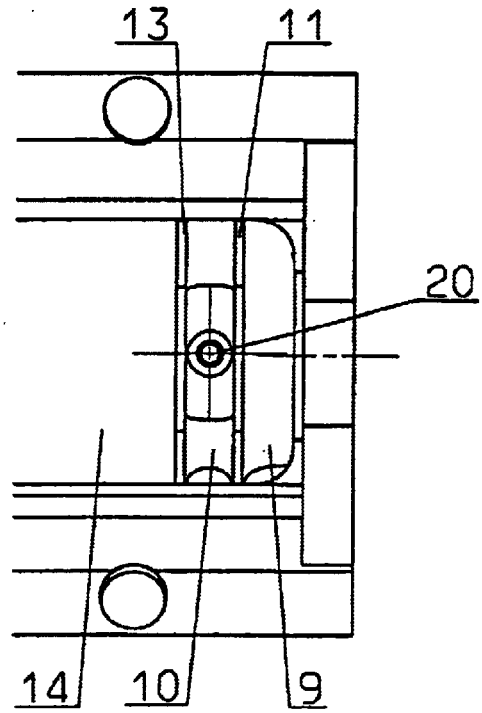
Figure 4:
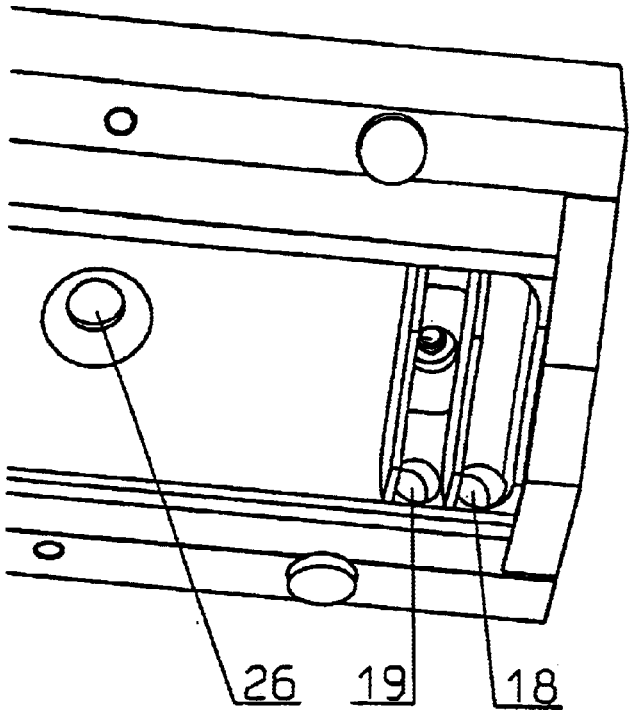

FIGS. 2 to 4 show views of the embodiment example mentioned, whereby the doctor blades and their support rails are not illustrated. These support rails are attached to the doctor blade chamber body 4 by means of the fastening elements 6. The end cover of the doctor blade chamber is achieved with the aid of the seal 7. This seal is produced of a flexible material in the embodiment example. The seal 7 has a clamping plate that is not illustrated, as the end stop unit. This clamping plate is locked on the doctor blade chamber body 4 by means of screws (also not illustrated), which engage into the threaded bores 17. In this regard, the seal 7 is usually locked between the stud 25 of the doctor blade chamber body 4 and the clamping plate. Between the seal and the dye zone 14 of the anilox roll are the two intermediate walls 11 and 13, which define the first and the second chambers 9 and 10.

It is obvious from this description that those sections of the anilox roll 2 are meant by dye zone 14, that are voluntarily dyed. In the device illustrated, this is the case in the areas of the anilox roll 2 that are central in axial direction, which are located between both second intermediate walls 13. The dyeing of the anilox roll in the area of the chambers 9, 10, which is absolutely possible, and the seal 7 in the edge areas of the dye roll occurs involuntarily.

For production technological reasons, both intermediate walls 11, 13 are part of a one-piece intermediate wall body 22 in the example shown, which is attached to the doctor blade chamber body 4 by means of a fastening screw 20. This fastening screw 20 is screwed into the threaded bore 21. Ink or ink residue that reached the two chambers is discharged through the bores 18 and 19 , which have the function of a drain. Of course, such a bore can also be embodied so that it takes on a drain function for several chambers at the same time. This is the case, for instance, when one intermediate wall 11 extends centrally across a bore, and the bore has a diameter that is larger than the thickness of the intermediate wall.

Figure 5:
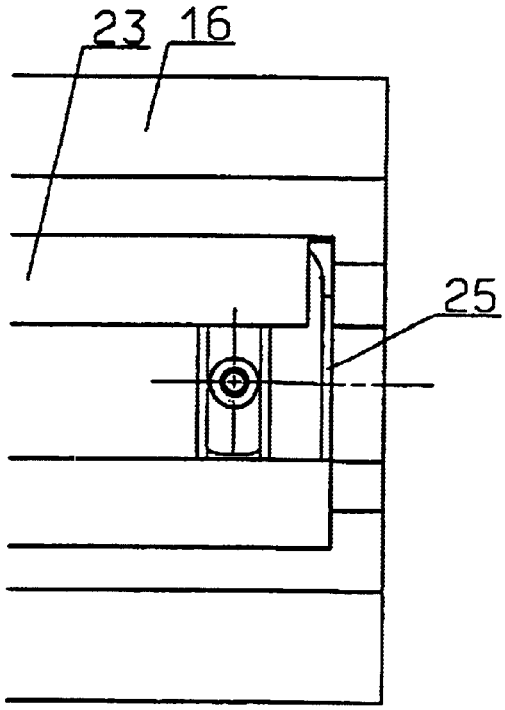
Figure 6:
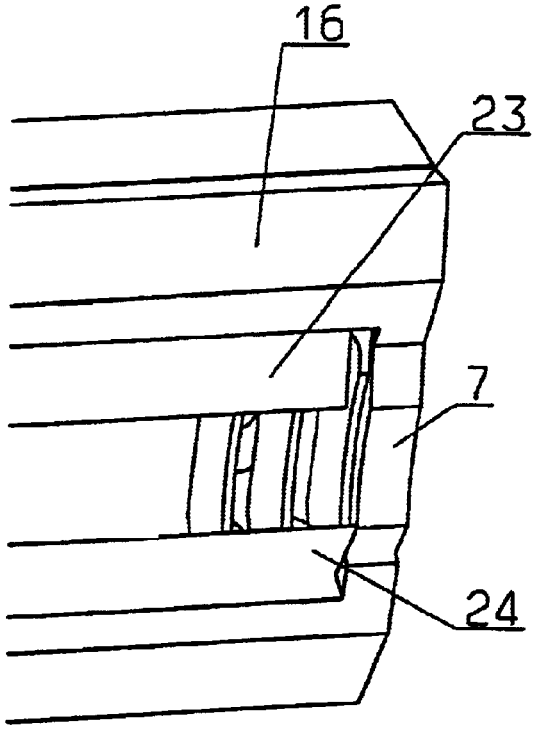
Figure 7:
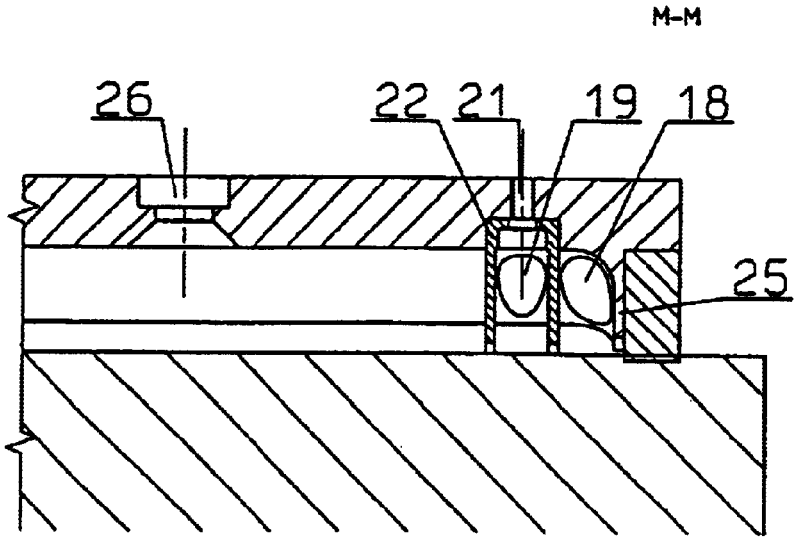
FIG. 7 A section along the line M—M, whereby the doctor blades and their support rails are not illustrated either.

FIGS. 5 to 7 show the embodiment example including the doctor blades and the support rails. The locking doctor blade 23 already ends, as mentioned, in the first chamber 9. Therefore, the doctor blade chamber 1 shown should not be tilted toward the locking doctor blade.

The difference mentioned several times to the FIGS. 2 to 4 already described exists in the illustration shown here of the support rails 16 for the doctor blades. FIG. 7 further shows essential characteristics of the invention in a section.

The discharge bores 18, 19, the one-piece intermediate wall body 22, and the seal 7 are clearly illustrated. Furthermore it is shown in which way the seal 7 is attached between the stud 25 of the doctor blade chamber body 4 and the not illustrated clamping area, which was mentioned in the description of the first embodiment example.

In both embodiment examples shown, merely one second intermediate wall was inserted. However, it is also possible, and in accordance with the invention, to insert additional intermediate walls. It should also be mentioned that ink supply lines are present in the central area of the ink chamber 1, which were not illustrated in the figures.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A doctor blade chamber for a rotation printing machine comprising:

an anilox roll that rotates around an axis during operation;

an elongated doctor blade chamber body that defines an ink chamber on a first side opposite said anilox roll;

two wedge-like doctor blades extending from said doctor blade chamber body and set to the anilox roll;

two sealing bodies that limit respective end portions of said ink chamber on either side of a dye zone, sealing surfaces of said sealing bodies being set against said anilox roll;

two first intermediate walls adjacent said sealing bodies, respectively, each of said walls being arranged between the dye zone and the respective sealing body to create respective first chambers on each side of the ink chamber; and at least one of said doctor blades having a length that ends between one of said intermediate walls and the sealing body on at least one end of said ink chamber.

2. The doctor blade chamber as set forth in claim 1, wherein the length of said at least one doctor blade ends in said first chambers.

3. The doctor blade chamber as set forth in claim 1, wherein said at least one doctor blade having the length that ends between one of said intermediate walls and the sealing body is a locking doctor blade for scraping off excess partially dried ink from said anilox roll.

4. The doctor blade chamber as set forth in claim 1, further comprising two second intermediate walls positioned respectively on each side of the ink chamber between the dye zone and said first intermediate walls to create respective second chambers on each side of the ink chamber.

5. The doctor blade chamber as set forth in claim 4, wherein each of said first chambers has an ink discharge bore for discharging ink from said first chambers, and at least one of said second chambers includes an additional ink discharge bore through which ink is discharged from said second chamber.

6. The doctor blade chamber as set forth in claim 5, wherein at least part of the ink discharged from said first chambers and from said second chamber is discharged by means of gravity.

7. The doctor blade chamber as set forth in claim 4, wherein said first and second intermediate walls on each side of said ink chamber are formed together by a one-piece intermediate wall body.

8. The doctor blade chamber as set forth in claim 7, wherein said one-piece intermediate wall body is secured to said doctor blade chamber body with a fastening element.

9. A doctor blade chamber for a rotation printing machine comprising:

an anilox roll that rotates around an axis during operation;

an elongated doctor blade chamber body that defines an ink chamber on a first side opposite said anilox roll;

two wedge-like doctor blades extending from said doctor blade chamber body and set to the anilox roll;

two sealing bodies that limit respective end portions of said ink chamber on either side of a dye zone, sealing surfaces of said sealing bodies being set against said anilox roll;

two first intermediate walls adjacent said sealing bodies, respectively, each of said walls being arranged between the dye zone and the respective sealing body to create respective first chambers on each side of the ink chamber;

two second intermediate walls positioned respectively on each side of the ink chamber between the dye zone and said first intermediate walls to create respective second chambers on each side of the ink chamber;

at least one of said doctor blades having a length that ends between one of said intermediate walls and the sealing body on at least one end of said ink chamber.

10. The doctor blade chamber as set forth in claim 9, wherein the length of said at least one doctor blade ends in said first chambers.

11. The doctor blade chamber as set forth in claim 9, wherein said at least one doctor blade having the length that ends between one of said intermediate walls and the sealing body is a locking doctor blade for scraping off excess partially dried ink from said anilox roll.

12. The doctor blade chamber as set forth in claim 9, wherein each of said first chambers has an ink discharge bore for discharging ink from said first chambers, and at least one of said second chambers includes an additional ink discharge bore through which ink is discharged from said second chamber.

13. The doctor blade chamber as set forth in claim 12, wherein at least part of the ink discharged from said first chambers and from said second chamber is discharged by means of gravity.

14. The doctor blade chamber as set forth in claim 9, wherein said first and second intermediate walls on each side of said ink chamber are formed together by a one-piece intermediate wall body.

15. The doctor blade chamber as set forth in claim 14, wherein said one-piece intermediate wall body is secured to said doctor blade chamber body with a fastening element.

* * * * *